US008142170B2

(12) United States Patent
Gollner

(10) Patent No.: US 8,142,170 B2
(45) Date of Patent: Mar. 27, 2012

(54) RADIAL PISTON PUMP

(75) Inventor: Wilhelm Gollner, Neumuenster (DE)

(73) Assignee: Sauer-Danfoss Inc., Ames, IA (US)

( * ) Notice: Subject to any disclaimer, the term of this patent is extended or adjusted under 35 U.S.C. 154(b) by 283 days.

(21) Appl. No.: 12/247,272

(22) Filed: Oct. 8, 2008

(65) Prior Publication Data

US 2009/0155095 A1 Jun. 18, 2009

(30) Foreign Application Priority Data

Dec. 18, 2007 (DE) ..... 10 2007 060 794

(51) Int. Cl.

| | |
|---|---|
| ***F04B 1/04*** | (2006.01) |
| ***F04B 27/053*** | (2006.01) |
| ***F04B 23/04*** | (2006.01) |
| ***F04B 41/06*** | (2006.01) |
| ***F01M 1/04*** | (2006.01) |
| ***F01B 31/10*** | (2006.01) |

(52) U.S. Cl. ..... 417/273; 417/36; 417/521; 184/6.6; 92/158

(58) Field of Classification Search ..... 417/273, 417/218, 221, 269, 366, 412, 415, 471, 481, 417/521; 92/158, 157, 159, 160; 184/6.5, 184/6.6, 6.8, 6.16, 24, 32

See application file for complete search history.

(56) References Cited

U.S. PATENT DOCUMENTS

| | | | | |
|---|---|---|---|---|
| 5,547,348 | A * | 8/1996 | Riley et al. | 417/273 |
| 5,944,493 | A * | 8/1999 | Albertin et al. | 417/273 |
| 5,983,781 | A * | 11/1999 | Ivantysyn | 92/71 |
| 2004/0037710 | A1 * | 2/2004 | Stewart et al. | 417/273 |

FOREIGN PATENT DOCUMENTS

| | | | |
|---|---|---|---|
| GB | 1128575 | * | 9/1968 |
| WO | WO2006003689 | * | 6/2005 |

OTHER PUBLICATIONS

H. Ebertshauser / S. Helduser, "Fluid Technology from A to Z", 2nd Edition, pp. 275-276, Germany.

* cited by examiner

*Primary Examiner* — Devon C Kramer
*Assistant Examiner* — Bryan Lettman
(74) *Attorney, Agent, or Firm* — Zarley Law Firm, P.L.C.

(57) ABSTRACT

A radial piston pump having external loading. The radial piston pump has an inner eccentric which is attached to a rotatable driveshaft, a cylinder block which has positionally fixed cylinder bores aligned radially with respect to the driveshaft, and displacement pistons which are mounted in a longitudinally movable manner in the cylinder bores. The displacement pistons have a piston head with a short casing height, and are mounted with their piston base on the eccentric, in such a way that the piston head, during its longitudinal movement, pivots in a predetermined angle range ($\Delta\alpha$) about the longitudinal central axis of the associated cylinder bore.

14 Claims, 4 Drawing Sheets

RADIAL PISTON PUMP

BACKGROUND OF THE INVENTION

The invention relates to a radial piston pump having the features of claim 1.

Radial piston pumps are a specific type of displacement pump having a plurality of pistons which are arranged in a star shape around and perpendicular to the drive axis. Said radial piston pumps can be acted on with pressure medium from the inside or from the outside and are generally suitable for constant high pressures.

In the case of externally loaded radial piston pumps which are supported at the inside, the pistons are supported on an eccentric which is situated on the driveshaft and are moved in a reciprocating fashion in the cylinders of a stationary cylinder block by the rotation of said eccentric. Here, the pressure medium flow is controlled by means of suction and pressure valves attached at the outside. The cylindrical pistons conventionally have, for guidance in the cylinders, a relatively large installation length in relation to the piston stroke, that is to say have a large casing height of the piston head, as a result of which a rectilinear movement of the pistons in the cylinders is ensured. Here, it is to be taken into consideration that, in the case of the conventionally single-piece pistons, transverse forces are unavoidable as a result of the eccentric drive, even if the support of the pistons on the eccentric takes place in a virtually punctiform manner, for example by means of a convex contact face. The conventional construction therefore results in a comparatively large outer diameter of the pump.

The different systems for radial piston pumps are described for example in H. Ebertshäuser/S. Helduser "Fluidtechnik von A bis Z" ["Fluid technology from A to Z"], Vereinigte Fachverlage, Mainz, 2nd edition 1995, pages 275-276.

It is the aim of the invention to create an improved radial piston pump.

SUMMARY OF THE INVENTION

According to the invention, this is achieved in a radial piston pump having external loading and having an inner eccentric which is attached to a rotatable shaft, having a cylinder block which has positionally fixed cylinder bores aligned radially with respect to the shaft, and having displacement pistons which are mounted in a longitudinally movable manner in the cylinder bores, in that the displacement pistons have a piston head with a short casing height, and are mounted with their piston base on the eccentric, in such a way that the piston head, during its longitudinal movement, pivots in a predetermined angle range $\Delta\alpha$ about the Longitudinal central axis of the associated cylinder bore. In this way, a considerable reduction in the outer diameter of the unit is obtained, which unit can therefore be of correspondingly compact design. It has been proven here that, despite the tilting of the piston head, a sufficient degree of sealing with respect to the cylinder bore can be obtained.

The cylinder bores which are situated in the cylinder block are preferably aligned in a star shape with respect to the driveshaft, with it also being possible to realize a unit in which at least two cylinder blocks which are aligned in a star shape are connected in series along a common crankshaft. This results in a correspondingly multiplied swept volume and therefore improved economy.

The angle range $\Delta\alpha$ which the displacement pistons travel through during their reciprocating movement in the cylinder bore is preferably $\Delta\alpha \geqq \pm 4°$, particularly preferably $\Delta\alpha \geqq \pm 5°$.

It is advantageous if the displacement pistons are of substantially cylindrical design in the region of the eccentric and are supported on the eccentric, or on a cylindrical roller bearing which surrounds the eccentric, by means of a hydrostatic plain bearing arrangement. In an alternative refinement of the invention, a bearing ring which surrounds the eccentric is provided, to which the displacement pistons are pivotably articulatedly connected.

The piston heads of the displacement pistons are preferably of convex design and have, for sealing in the cylinder bores, at least in each case one piston ring per displacement piston. This ensures firstly the sealing action in the cylinder bore and secondly a sufficient freedom of movement of the piston head.

For the pressure medium supply to the hydrostatic plain bearing arrangement on the eccentric or for the lubricant supply to the articulated connection of the displacement pistons to a bearing ring which surrounds the eccentric, the displacement pistons preferably have a corresponding inner bore which extends through the displacement piston lengthwise and permits a metered pressure medium supply.

Further features and advantages of the invention can be gathered from the following description of the figures, in which:

DETAILED DESCRIPTION OF THE PREFERRED EMBODIMENT

Figure 1:
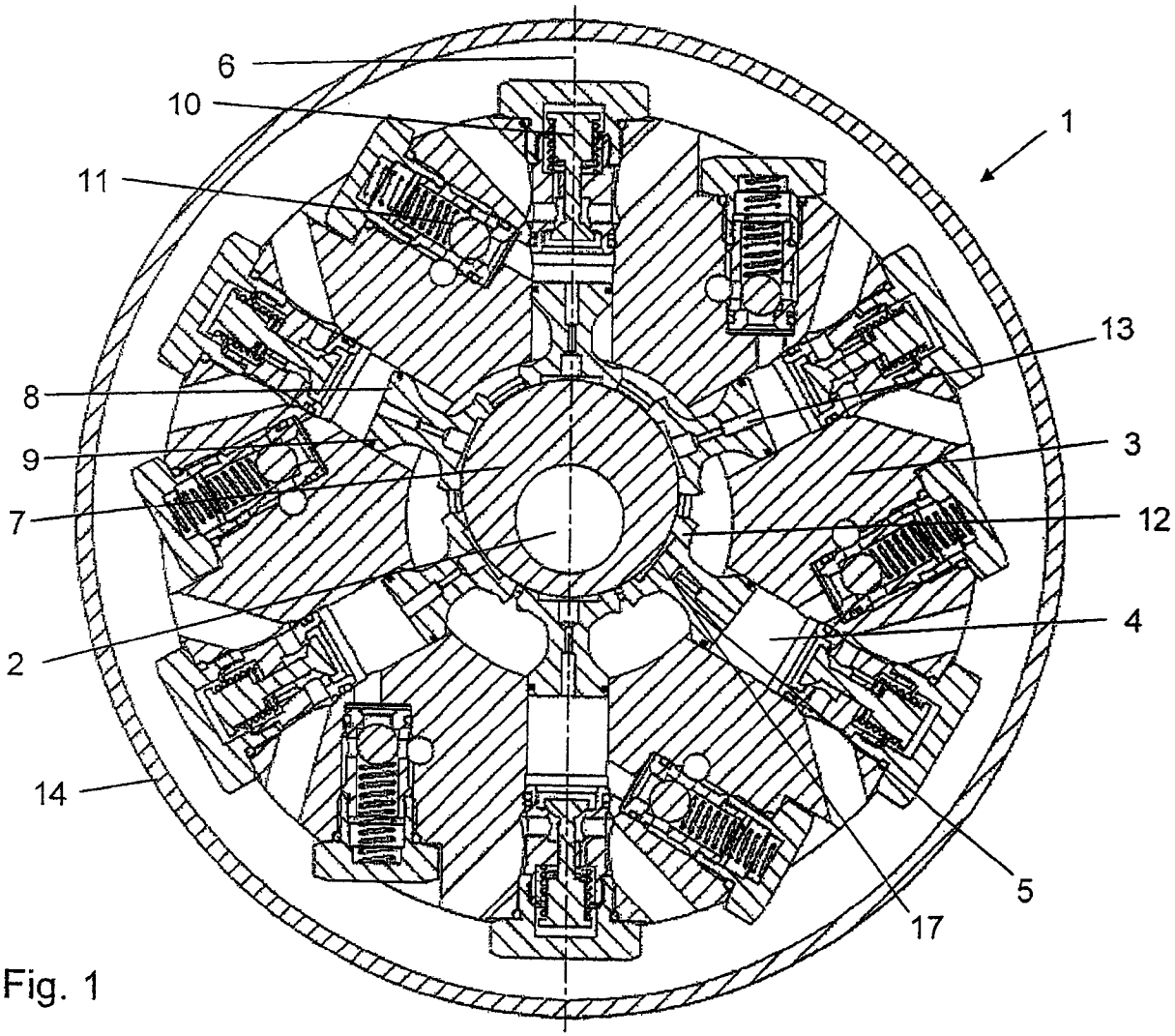
FIG. 1: shows a first exemplary embodiment of the invention.

FIG. 1 illustrates a first exemplary embodiment of the invention. The radial piston pump 1 has a schematically illustrated housing 14 in which is accommodated the cylinder block 3 with the cylinder bores 4. Displacement pistons 5 are mounted in a longitudinally movable manner in the cylinder bores 4. In the direction of the eccentric 7, said displacement pistons 5 have a substantially cylindrical basic shape. Said displacement pistons 5 are supported here in each case with the piston base 12 by means of a hydrostatic plain bearing arrangement on an inner eccentric 7 which is connected to the driveshaft 2 and which is driven by the latter. For this purpose, the displacement pistons 5 have an inner bore 13 along the piston axis, which inner bore 13 opens out into a central recess 17 of the piston base 12 and via which inner bore 13 the pressure fluid passes in a metered quantity to the surface of the plain bearing arrangement. The piston head 8 which slides in the cylinder bore 4 is likewise cylindrical in basic shape, but has a small casing height in such a way that it can follow the tilting movement, caused by the eccentric movement, relative to the longitudinal central axis 6, illustrated in FIG. 1 by way of example in two oppositely-situated cylinders, of the cylinder bore 4.

In the illustrated exemplary embodiment, the piston head 8 is of convex design. The sealing action with respect to the cylinder bore is ensured by means of a piston ring 9. The piston head 8 can fundamentally also be of circular cylindrical design with a correspondingly short casing height. The sealing action can, if appropriate, take place with two or three piston rings 9. The cylinder bores 4 are aligned in a star shape radially towards the driveshaft 2. The loading with pressure fluid takes place at the outside. As a result of the vacuum generated during the return movement of the displacement piston 5, the suction valve 10 opens and thereby allows pressure fluid to flow back into the cylinder bore 4. At the inner dead centre of the displacement piston 5, the suction valve 10 closes under spring pressure, and at the same time the outlet valve 11 opens, so that the displacement piston 5 can press the displacement volume into the work performed by the pump.

Figure 2:
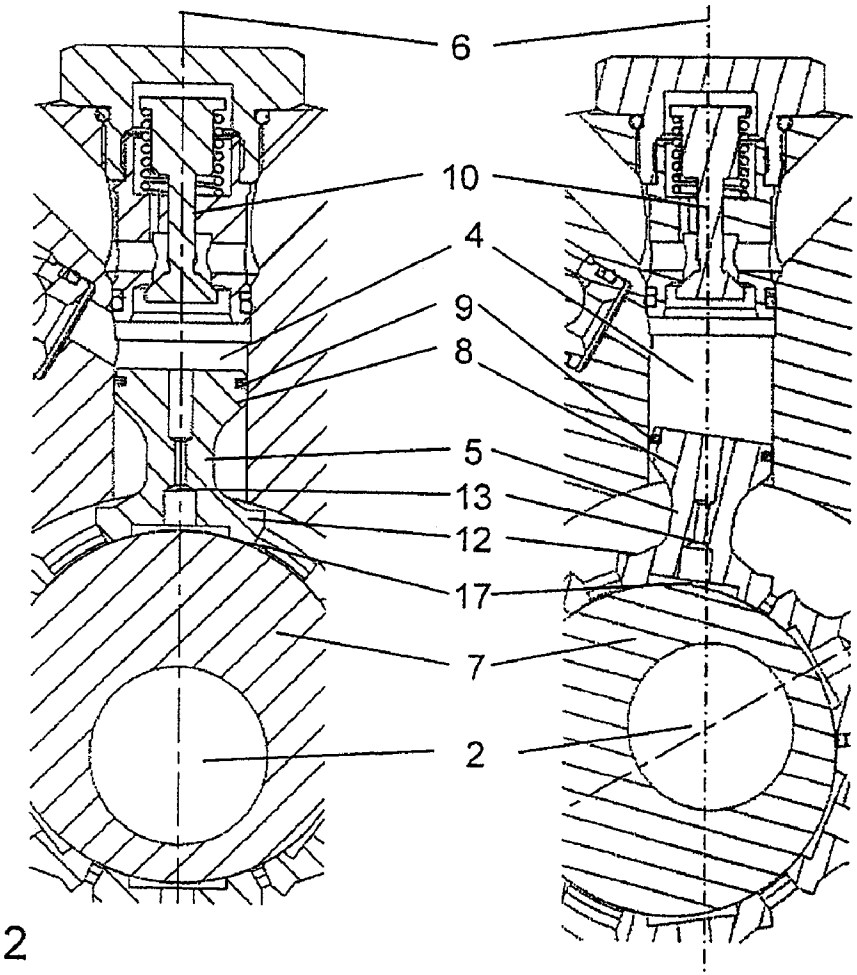
FIG. 2: shows details of the piston guidance in the first exemplary embodiment.

The mode of operation of the radial piston pump is illustrated again in detail in FIG. 2 on the basis of two positions of the displacement piston 5. As a result of the rotation of the eccentric 7 which is connected to the driveshaft 2, the displacement pistons 5 in the cylinder bores 4 are moved in a reciprocating fashion. The piston base 12 is substantially cylindrical and has a central recess 17 into which a stepped inner bore 13 opens out, which inner bore 13 extends lengthwise through the displacement piston 5. Here, the inner bore 13 is dimensioned such that the pressure fluid which enters through the suction valve 10 can pass from the cylinder bore 4 to the plain bearing arrangement of the piston base. The displacement piston 5 has a small installation length. On account of the hydrostatic plain bearing arrangement on the eccentric 7, no long cylindrical guidance of the piston head 8 is necessary, which piston head 8 can therefore be of very short design with a small casing height. In the example shown, said piston head 8 is of convex design, which facilitates the pivoting movement relative to the longitudinal central axis 6 of the cylinder bore 4. On account of the extended period of contact against the eccentric 7, the displacement piston 5 performs a pivoting movement with its piston head 8 at an angle about the longitudinal central axis 6 of the cylinder bore 4. In the exemplary embodiment illustrated, the displacement piston 5 travels through an angle range of approximately ±5° about the longitudinal axis 6 of the cylinder bore 4. One or more piston rings 9 serve to provide sealing with respect to the cylinder bore 4.

Figure 3:
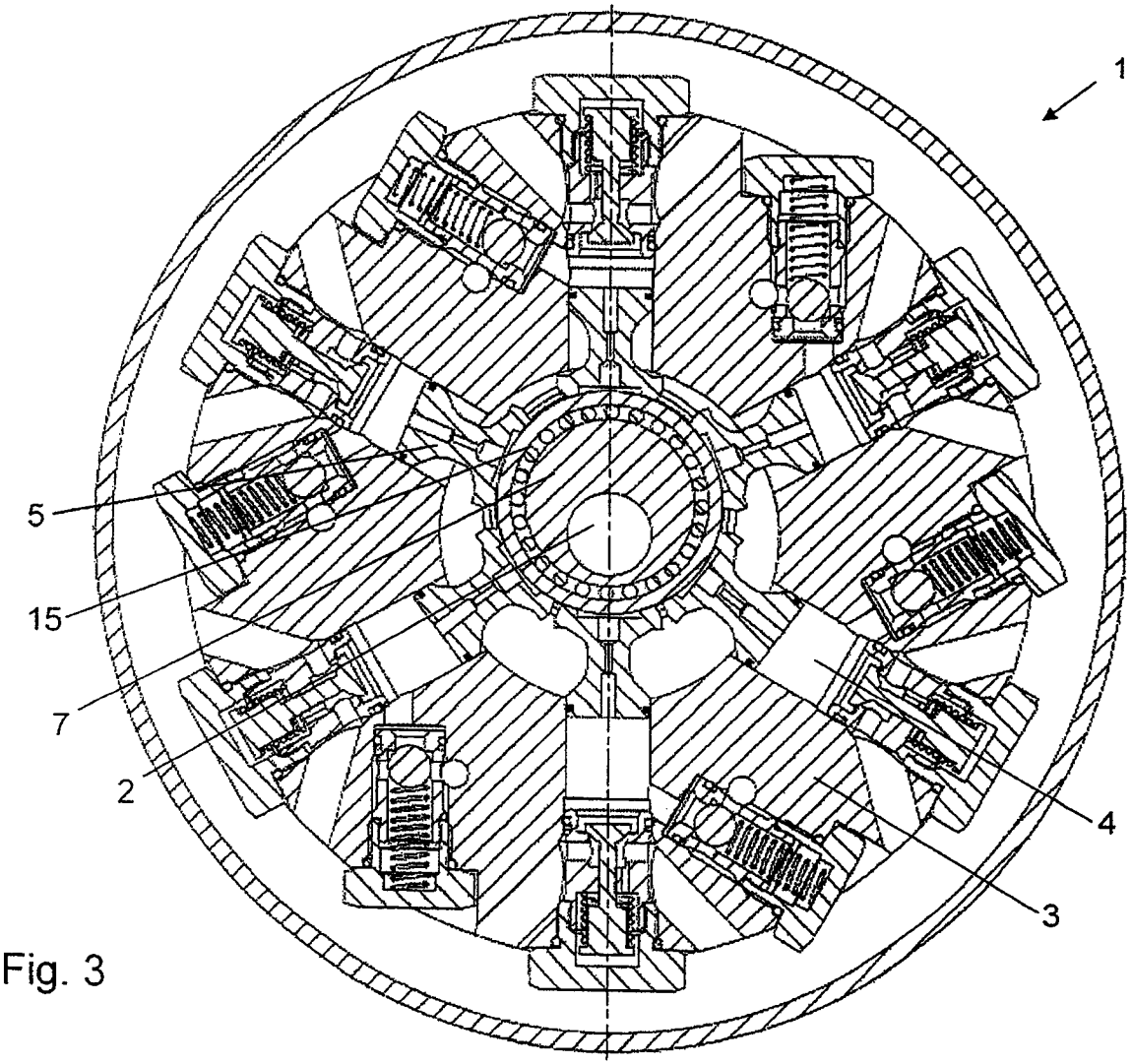
FIG. 3: shows a second exemplary embodiment.

FIG. 3 illustrates a second exemplary embodiment. The same reference symbols have been used for identical components. The eccentric 7 which is connected to the driveshaft 2 is in this example surrounded by a cylindrical roller bearing 15 on which the displacement pistons 5 are supported. As was described on the basis of FIG. 1, the displacement pistons 5 are again mounted in a longitudinally movable manner in the cylinder bores 4 of the cylinder block 3 and, during said movement, travel through in each case an angle range of approximately ±5°. The remaining components correspond to those of the exemplary embodiment of FIG. 1, to the description of which reference is made.

Figure 4:
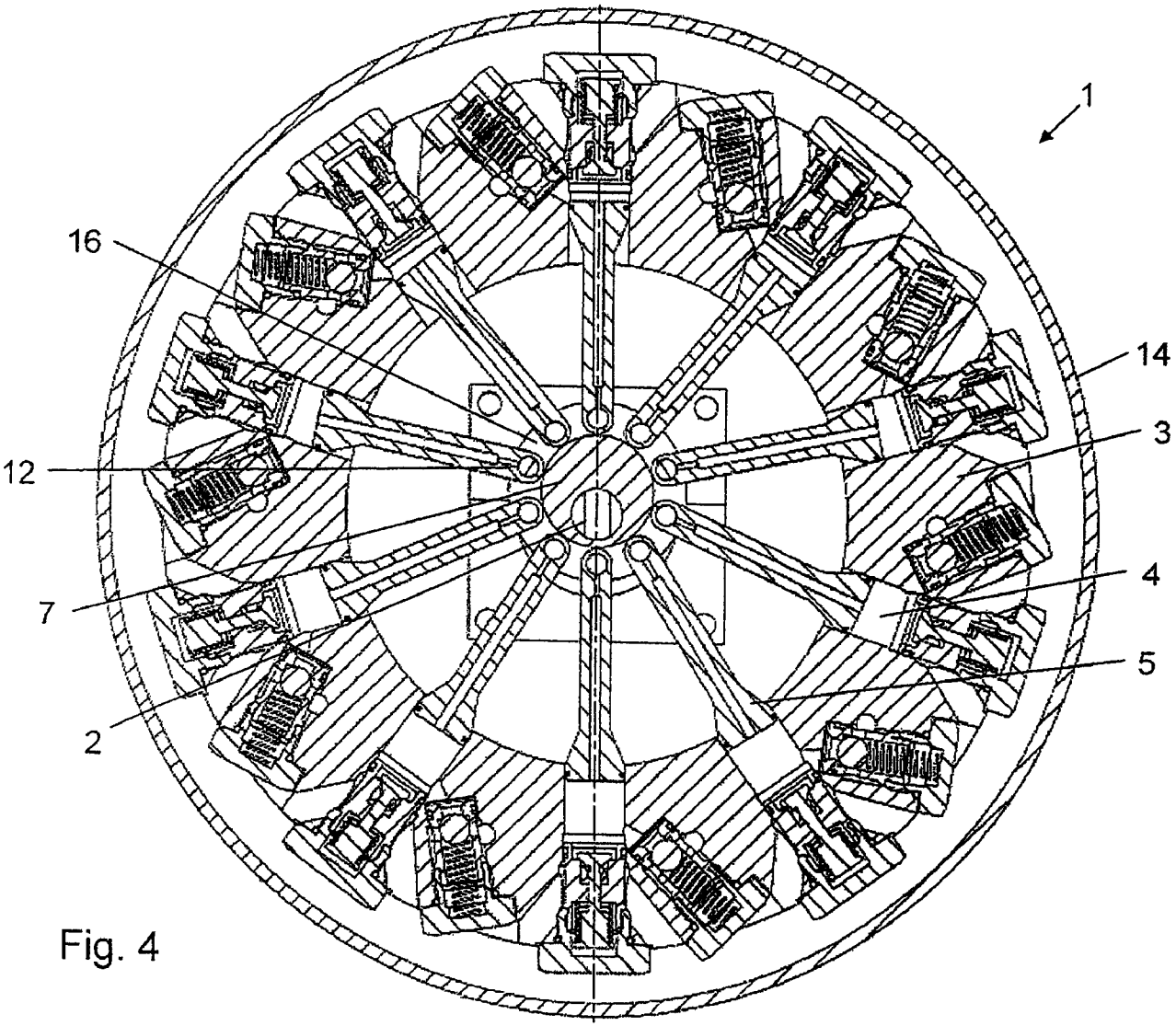
FIG. 4: shows a third exemplary embodiment.

FIG. 4 shows a further exemplary embodiment. As already described above, the radial piston pump 1 has a housing 14 in which the cylinder block 3 with the cylinder bores 4 is situated. Here, the displacement pistons 5 are pivotably articulatedly connected with the piston base 12 to a bearing ring 16 which surrounds the eccentric 7 and the driveshaft 2. The bearing ring 16 can for example be embodied as an outer cylinder of a cylindrical roller bearing or as a bearing sleeve for the eccentric 7. As a result of the rotation of the eccentric 7, the bearing ring 16 moves, which bearing ring 16 as a result moves the displacement pistons 5 in the cylinder bores 4 in a reciprocating fashion. As the eccentric 7 rotates, the piston head 8 of the displacement piston 5 performs a tilting movement and, here, travels through a predetermined angle range in the respective cylinder bore 4.

In all of the above-described exemplary embodiments, a single-piece displacement piston with a piston head of very short installation length is provided, with said installation length in connection with the support of the displacement piston on the eccentric making it possible for the piston head, during its reciprocating movement in the cylinder, to perform a pivoting movement about the cylinder axis, resulting in a particularly favourable compact design for the radial piston pump and a surprisingly high degree of sealing of the displacement pistons in the cylinder bore.

The invention claimed is:

1. A radial piston pump having an external loading and having an inner eccentric (7) which is attached to a rotatable driveshaft (2), having a cylinder block (3) which has positionally fixed cylinder bores (4) aligned radially with respect to the driveshaft (2), and having displacement pistons (5) which are mounted in a longitudinally movable manner in the cylinder bores (4), with each of the displacement pistons (5) having a piston head (8) with a short casing height, and being mounted with a piston base (12) on the eccentric (7), in such a way that the piston head (8), during a longitudinal movement, pivots in a predetermined angle range ($\Delta\alpha$) about a longitudinal central axis (6) of an associated cylinder bore (4), and wherein the displacement pistons (5) are formed as a single piece including the piston head (8) and the piston base (12) and include a stepped inner bore (13) extending lengthwise through the displacement pistons (5) from the piston head (8) to the piston base (12) and a straight bore through the piston base (12) such that a metered quantity of a pressurized fluid passes from the cylinder bores (4) through the stepped inner bore (13) to a surface of the eccentric (7); and wherein the piston base (12) has a central recess (17) into which the straight bore opens out such that the displacement pistons (5) are supported on the eccentric (7) by a hydrostatic plain bearing arrangement formed in the central recess (17).

2. The radial piston pump according to claim 1, in which the cylinder bores (4) which are situated in the cylinder block (3) are aligned in a star shape with respect to the driveshaft (2).

3. The radial piston pump according to claim 2, in which at least two of the cylinder bores (4) which are aligned in the start shape are connected in series along the common driveshaft.

4. The radial piston pump according to claim 1, in which the angle range is $(\Delta\alpha) \geqq \pm 5°$.

5. The radial piston pump according to claim 1, in which the displacement pistons (5) are of a substantially cylindrical design.

6. The radial piston pump according to claim 1, in which the piston heads (8) of the displacement pistons (5) each have at least one piston ring (9) for sealing in the cylinder bores (4).

7. The radial piston pump according to claim 1, in which the external loading is controlled by means of at least one suction and one outlet valve (10, 11).

8. A radial piston pump having an external loading and having an inner eccentric (7) which is attached to a rotatable driveshaft (2), having a cylinder block (3) which has positionally fixed cylinder bores (4) aligned radially with respect to the driveshaft (2), and having displacement pistons (5) which are mounted in a longitudinally movable manner in the cylinder bores (4), with each of the displacement pistons (5) having a piston head (8) with a short casing height, and being mounted with a piston base (12) on the eccentric (7), in such a way that the piston head (8), during a longitudinal movement, pivots in a predetermined angle range ($\Delta\alpha$) about a longitudinal central axis (6) of an associated cylinder bore (4), and wherein the displacement pistons (5) are formed as a single piece extending from the piston head (8) within the cylinder bores (4) to the piston base (12) mounted on the eccentric (7) and include a stepped inner bore (13) extending lengthwise through the displacement pistons (5) such that a metered quantity of a pressurized fluid passes from the cylinder bores (4) through the stepped inner bore (13) to a surface of the eccentric (7); and wherein the piston base (12) includes a central recess (17) on the eccentric (7) into which the stepped inner bore (13) opens out such that the displacement pistons (5) are supported on the eccentric (7) by a hydrostatic plain bearing arrangement formed in the central recess.

9. The radial piston pump according to claim 8, in which the cylinder bores (4) which are situated in the cylinder block (3) are aligned in a star shape with respect to the driveshaft (2).

10. The radial piston pump according to claim 9, in which at least two of the cylinder bores (4) which are aligned in the start shape are connected in series along the common driveshaft.

11. The radial piston pump according to claim 8, in which the angle range is $(\Delta\alpha) \geqq \pm 5°$.

12. The radial piston pump according to claim 8, in which the displacement pistons (5) are of a substantially cylindrical design.

13. The radial piston pump according to claim 8, in which the piston heads (8) of the displacement pistons (5) each have at least one piston ring (9) for sealing in the cylinder bores (4).

14. The radial piston pump according to claim 8, in which the external loading is controlled by means of at least one suction and one outlet valve (10, 11).

* * * * *